US007806381B2

(12) United States Patent
Sisk Horne et al.

(10) Patent No.: US 7,806,381 B2
(45) Date of Patent: Oct. 5, 2010

(54) STABILIZATION AND SUPPORT STRUT WITH SECURE DEPLOYMENT FEATURES

(75) Inventors: Tammy Sisk Horne, Gastonia, NC (US); Kevin Sullivan, Cramerton, NC (US)

(73) Assignee: Hale Products, Inc., Ocala, FL (US)

( * ) Notice: Subject to any disclaimer, the term of this patent is extended or adjusted under 35 U.S.C. 154(b) by 612 days.

(21) Appl. No.: 11/842,442

(22) Filed: Aug. 21, 2007

(65) Prior Publication Data

US 2009/0050771 A1 Feb. 26, 2009

(51) Int. Cl.
*A47F 5/00* (2006.01)

(52) U.S. Cl. ..... 248/354.5; 248/125.8; 248/159; 248/354.1; 403/109.1

(58) Field of Classification Search ..... 248/354.5, 248/125.8, 125.7, 125.9, 161, 406.1, 407, 248/408, 409, 410, 411, 413, 159, 157, 354.1, 248/354.6, 354.7, 357, 162.1; 403/109.1, 403/109.2, 109.3, 109.4, 109.6, 109.8, 377, 403/378, 379.1, 379.2, 379.3, 379.4, 379.5, 403/379.6, 83, 92, 93, 107

See application file for complete search history.

(56) References Cited

U.S. PATENT DOCUMENTS

| | | | | |
|---|---|---|---|---|
| 3,822,850 | A * | 7/1974 | Elias | 248/551 |
| 4,169,687 | A * | 10/1979 | Schull | 403/109.3 |
| 4,570,677 | A | 2/1986 | Roxton et al. | |
| 4,576,501 | A * | 3/1986 | McConnell | 403/59 |
| 5,590,863 | A * | 1/1997 | Sasaki | 248/354.3 |
| 5,810,333 | A | 9/1998 | Hickerson et al. | |
| 5,924,658 | A * | 7/1999 | Shiery et al. | 248/125.8 |
| 6,017,170 | A | 1/2000 | Michalo | |
| 6,158,705 | A | 12/2000 | Cudmore et al. | |
| 6,394,405 | B1 | 5/2002 | Roxton et al. | |
| 6,746,183 | B1 | 6/2004 | Sullivan | |

(Continued)

FOREIGN PATENT DOCUMENTS

| | | |
|---|---|---|
| EP | 1069261 A1 | 1/2001 |

(Continued)

OTHER PUBLICATIONS

Airshore International, "ART Collection," brochure published by Airshore International, U.S.

*Primary Examiner*—Anita M King
(74) *Attorney, Agent, or Firm*—Summa, Additon & Ashe, P.A.

(57) ABSTRACT

A stabilization and support strut for use in rescue operations in buildings, trenches, vehicle accidents, and the like has secure deployment features including first and second inter-fitting collar assemblies, the first collar assembly including a first collar, circumferentially based spring-biased piston-retaining pins mounted in the collar for fitting into orifices in a piston body, and a locking pin for precluding rotation and axial movement of the first collar on the strut; and the second collar assembly including a second collar rotatingly secured on the barrel with a portion of the second collar underlying the first and having a circumferentially inclined ratchet surface for snugly engaging the piston-retaining pins upon rotation of the second collar, the second collar further including rotatable studs for engaging the barrel and precluding rotation of the second collar about the barrel when snug against the piston-retaining pins.

17 Claims, 10 Drawing Sheets

U.S. PATENT DOCUMENTS 6,752,570 B2 6/2004 Lanka
6,772,984 B2 8/2004 Pasto
6,776,383 B2 8/2004 Lanka
6,964,542 B1 11/2005 Sullivan
7,490,813 B1 * 2/2009 Weddle ..... 254/93 R
7,584,932 B2 * 9/2009 Shih ..... 248/354.3

FOREIGN PATENT DOCUMENTS

WO 9834871 A1 8/1998
WO 2004090260 A1 10/2004

* cited by examiner

STABILIZATION AND SUPPORT STRUT WITH SECURE DEPLOYMENT FEATURES

FIELD OF THE INVENTION

This invention relates to stabilization and support apparatus, and, in particular, to apparatus deployed in rescue and recovery operations in buildings, trenches, vehicle accidents, and the like.

BACKGROUND OF THE INVENTION

First responders approaching an accident scene typically determine what is of most immediate danger to the victim's life and themselves in rescuing that victim. Reaching the victim safely generally requires an initial assessment of the accident scene followed by stabilization and structural support of surrounding surfaces, whether the accident involves an automobile crash, a potential building collapse, a potential collapse of a wall below grade level, as in a trench, or other hazard of the accident scene. Speed of deployment and set-up are of paramount importance to the first responder.

A variety of tools have been developed over the years for supporting and stabilizing surfaces in rescue operations. These tools can be used to secure an automobile body in place so that rescuers can cut open the passenger compartment to reach a victim, to secure a ceiling in place and provide structural support against collapse, and to hold open passageways in mining accidents or trenches in below-grade construction projects. Such valuable tools include the vehicle stabilization and support tools shown in FIG. 1 and labeled "prior art" and as described in U.S. Pat. No. 6,158,705. As shown in this patent, this tool has a retractable and extendable pneumatically-assisted piston that can be extended from a cylinder or barrel and fixed in place to provide a brace. The piston extends to the desired length and the barrel secures the piston in place by a surrounding annular collar assembly to which is attached by a lanyard a pin that inserts through holes in the piston. The collar, with its locking studs released, rotates up against the pin for final adjustment of piston length and a tight supporting fit. Internal annular step surfaces in the collar engage corresponding inclined circumferential surfaces on the end of the barrel to provide for movement of the collar axially of the barrel to fit tight against the pin inserted into the piston. Locking studs are turned to secure the collar tight against the barrel once the collar is snug against the pin.

The tool shown in FIG. 1 herein is somewhat similar. The upper end of the collar provides inclined circumferential surfaces rotatingly to engage a pair of pins inserted through the piston. The upper surfaces of the barrel are flush and "T-handled" locking studs secure the collar to the barrel to preclude further rotation of the collar and to hold the collar tight against the pins during use.

While successful and secure in use, the tools described above sometimes cause problems in deployment. A rescuer normally will initially determine the length of structural support needed and release the locking system on the collar prior to placing the tool in a trench, under a ceiling, or engaging an automobile. If the pins fall out of the holes in the piston during transport or deployment, the piston may fall out of the barrel. The collar may separate from the barrel if the locking studs have been disengaged. Lanyards attaching pins to the locking studs may prove clumsy in use and get in the rescuers' way.

It would be desirable to provide a stabilization and support strut that reduces or eliminates problems in deployment.

SUMMARY OF THE INVENTION

The invention provides improvements in the transport and deployment of stabilization and support struts of the type used in rescue operations. Cooperating first and second annular collar assemblies rotatably secure the barrel for transport and deployment of the strut, provide for longitudinal extension and retraction of the piston, and secure the piston in position for use with a snug fit. When released for deployment of the strut, the collar assemblies remain secured to the barrel.

The first collar assembly releases the piston for extension and retraction and secures the piston at the correct length. The second collar assembly rotatably secures the barrel and can be locked down to provide a snug fit against the first collar assembly to hold the piston tight in position. When the first collar assembly releases the piston for extension and retraction, the first responder moves the piston axially in the barrel and the first and second collars remain in cooperating secured relation on the barrel. An elastomeric sealing member located at the bottom of the piston precludes the piston from falling out of the barrel and provides for readily reducing the piston length and pneumatically extending the piston. When the piston is in the correct position, the first responder then secures the piston with the first collar assembly, rotatably tightens the second collar assembly against the first, and secures the second collar assembly to the barrel to preclude further rotation and to secure the piston in the correct position.

In a specific embodiment, the invention provides first and second annular collar assemblies including first and second inter-fitting annular collars, the first collar circumferentially circumscribing an upper portion of the second collar. Biased piston-retaining pins fixedly attached to the first annular collar secure and release the piston for extension and retraction. The pins extend from knobs on the outer circumference of the first annular collar through corresponding cooperating orifices in the first collar and piston and retract out of the piston orifices against a spring to release the piston for extension and retraction from the barrel. A retractable, biased first-collar locking pin retractably fixed to the first collar, engages a portion of the outer circumference of the second collar that extends radially inwardly of the first collar to preclude rotation of the first collar about the second when the strut is stored. The first responder retracts the first-collar locking pin and then the piston-retaining pins to move the piston axially of the barrel for deployment and to rotatingly locate the holes in the piston for securing the piston.

The second collar includes a reduced outer diameter portion that extends longitudinally under the circumference of the first collar, by which the first and second collars are interfitted. The second collar includes a larger outer diameter portion that extends longitudinally below the first collar. Thumb grooves in the surface of the larger outer diameter portion of the second collar provide grip so that the first responder can rotate the second collar from any angle. The second annular collar assembly includes a track circumscribing its inner circumference below the first collar for accommodating a pair or more of second-collar rotation pins rotatably fixing the second annular collar to the barrel. The barrel rigidly fixes the pins, and the pins extend from the barrel into the close-fitting track on the inner circumference of the second collar. The second collar rotates about the barrel as the rotation pins travel in the close-fitting track.

The reduced diameter portion of the second collar provides a circumferentially inclined ratchet surface on an upper portion of the collar for engaging piston-retaining pins in the first collar for a snug fit to secure the piston in the barrel. The second collar provides second-collar locking studs extending through the collar to engage the barrel and secure the second collar to the barrel, thus precluding further rotation of the second collar and locking the piston in position when the strut is fully deployed.

Thus, the invention provides an apparatus and method for deploying a strut having a barrel and an extendable and retractable piston in which the strut includes first and second collar assemblies, the first collar assembly including a first collar and retractably fixed piston-retaining pins for securing and releasing the piston, the second collar assembly including a second collar rotatably secured to the barrel for adjusting the length of the piston and fixedly secured to the barrel for a secure piston fit in deployment against the piston-retaining pins. The method of the invention includes the steps of releasing the piston for axial movement by retracting the piston-retaining pins against the first collar, axially adjusting the piston length, then re-inserting the piston-retaining pins into the piston at the adjusted length, rotating the second collar about the barrel to engage the piston-retaining pins, and securing the second collar against rotation about the barrel.

The foregoing and other advantages and features of the invention and the manner in which the same are accomplished will be more readily apparent upon consideration of the following detailed description of the invention taken in conjunction with the accompanying drawings, which illustrate preferred and exemplary embodiments.

BRIEF DESCRIPTION OF THE DRAWINGS

Corresponding reference characters indicate corresponding parts throughout the several views of the drawings.

DETAILED DESCRIPTION OF THE INVENTION

Figure 1:
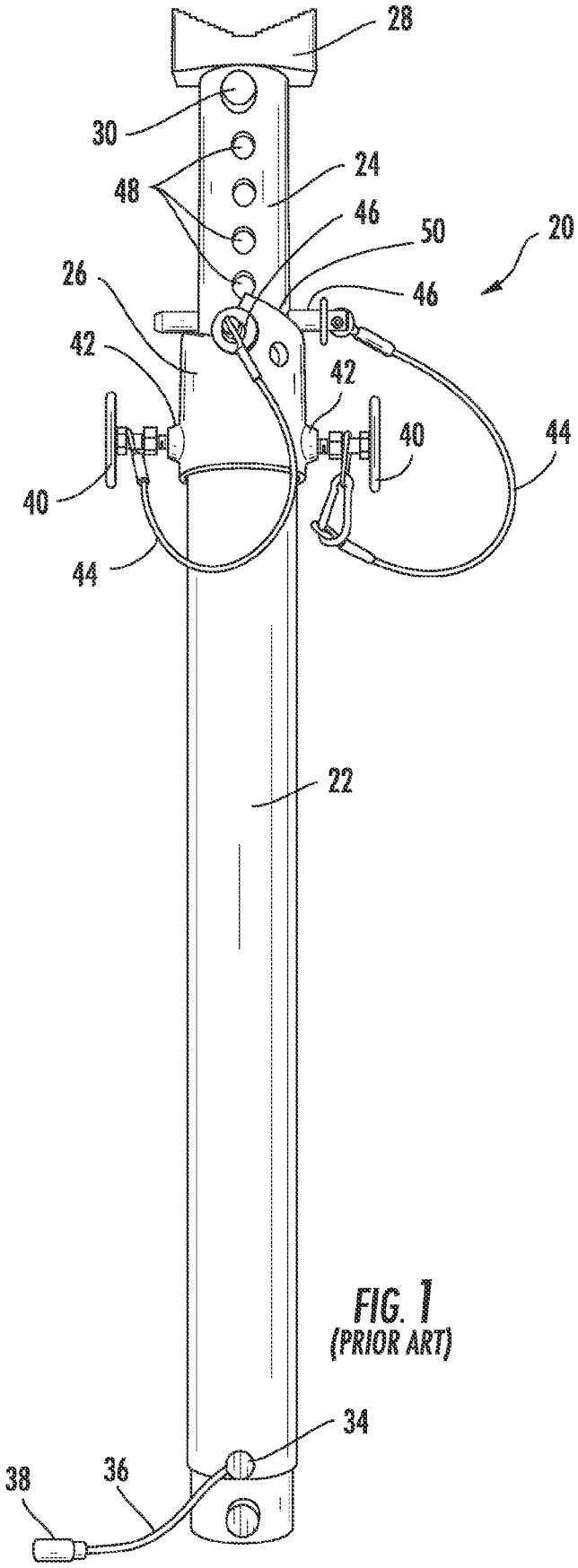
FIG. 1 (PRIOR ART)
FIG. 1 is a longitudinal perspective view from the front center-line of a stabilization and support tool of the prior art in which a piston is inserted in a barrel.

The invention can best be understood with reference to the specific embodiment that is illustrated in the drawings and the variations described herein below. While the invention will be so described, it should be recognized that the invention in not intended to be limited to the embodiments illustrated in the drawings. On the contrary, the invention includes all alternatives, modifications, and equivalents that may be included within the spirit and scope of the invention as defined by the appended claims.

FIG. 1 illustrates generally at 20 a stabilization and support tool of the prior art, having a barrel 22 and a hollow piston 24 of smaller diameter inserted into the barrel and extending from the barrel. A collar assembly 26 secures the piston against axial movement in the barrel to provide a strut suitable for rescue operations. A V-block 28 is inserted into the upper end of the piston and held in place by a quick disconnect 30. The V-block is stepped on its upper surface for secure support of, for example, a supporting joist or a vehicle body, which is not shown. The opposite end of the strut has a quick disconnect mounted in the barrel for attachment of a foot structure, which is not illustrated, including, for example, a hinged plate that can accommodate the various angles of surfaces of the supporting structure against which the strut is braced. It should be recognized that there are a wide variety of attachment structures that may be secured by the quick disconnects at the bottom of the barrel and the top of the piston for a variety of rescue situations. A nipple 34 provides connection to an air source including, for example, a foot pump or another air control unit for pneumatically assisting extension and retraction of the piston. Attached to the nipple by a cord 36 is a plug 38 for covering the nipple to limit exposure to dirt and moisture when the nipple is not connected to the air source.

Collar 26 of the prior art secures against rotation on the barrel by "T-handled" studs 40 screwed into threaded orifices 42 in the collar. The collar rotates freely on the barrel when the studs are not engaged with the barrel surface. Lanyards 44 attached to the T-handled studs fix retaining pins 46 to the studs and collar that are inserted through orifices 48 on opposite sides of the piston to retain the piston in position against axial movement in the barrel. The collar includes an inclined circumferential surface 50 at the upper end thereof that, upon rotation into contact with the retaining pins and engagement of the studs 40 to preclude further rotation, holds the retaining pins in place and secures the piston's position axially of the barrel.

Struts as shown in FIG. 1 are generally available in a variety of lengths of from about 13 to 93 inches, with matching pistons in lengths from about 8 to 85 inches and with a variety of attachments for the piston head and barrel foot depending on the specific application for which they are called. The first responder typically will carry a variety of lengths of struts, head block structures, and feet on a rescue vehicle, and determine which struts and attachments are to be deployed upon an initial assessment of an accident scene. The individual struts are adjustable over a range of lengths by extending or retracting the piston from the barrel and securing the piston in place with respect to the barrel with the retaining pins and collar.

Figure 2:
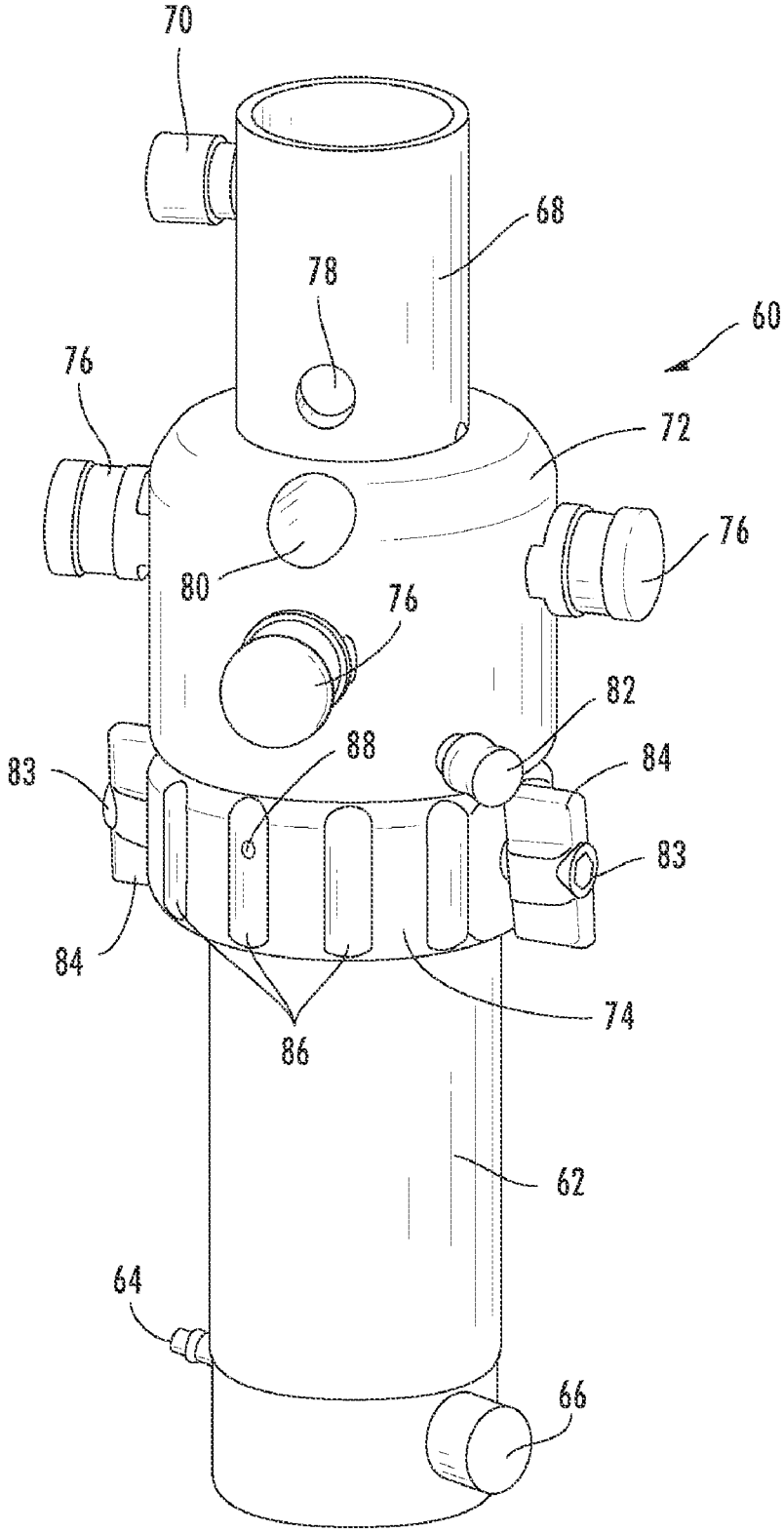
FIG. 2 is a longitudinal perspective view from the left hand of center of a strut of the invention.

FIG. 2 shows generally at 60 a longitudinal perspective view from the left hand of center of a strut of the invention. This strut has a barrel 62 with an air nipple 64 and quick disconnect 66, and a piston 68 with a quick disconnect 70 on the end of the strut opposite the quick disconnect 66 on the barrel. These features are conventional and similar to those of the prior art illustrated in FIG. 1.

FIG. 2 also illustrates first and second collar assemblies that include first and second collars 72 and 74. The first collar assembly includes four piston-retaining pins 76 equidistantly spaced circumferentially about the first collar and extending therefrom. The one pin in the rear of the strut is not seen in this view. These piston-retaining pins interact with corresponding orifices 78 in the piston to retain the piston axially in place inserted in the barrel. The first collar is also illustrated in FIG. 2 with an optional viewing port 80 to allow the first responder to see the orifices 78 in the piston for determining that the piston-retaining pins are lined up with the orifices in the piston. The first collar includes a first collar locking pin 82, described in more detail below with respect to FIG. 8, which engages a reduced diameter portion of second collar 74 that extends under the first collar to preclude rotation of the first collar about the piston and barrel. The portion of the second collar extending under the first collar is illustrated in FIGS. 3 and 9.

The second collar 74 is rotatably secured on the barrel 62 longitudinally below the first collar 72 for 360° rotation. The second collar can also be secured against rotation with respect to the barrel by studs 83 with handles 84 that extend radially inwardly through the second collar for tightening against the surface of the barrel. The second collar has a plurality of grooves 86 cut into its outer surface to provide a secure grip to the first responder for rotation of the second collar with respect to the barrel and the first collar when the studs 83 have released the second collar for rotation. The second collar is rotatably secured to the barrel by a track 106 and corresponding pins 108, which are not shown in this view and are described further hereinbelow in connection with FIG. 3. A small orifice 88 on one of the finger grooves 86 provides access for inserting one or more pins 108 into the barrel wall for securing the second collar and locating the pin in the corresponding track 106 for rotation.

If desired, eyebolts for attachment points for transporting the struts can be placed at each end of the strut adjacent the quick disconnects. First responders may use caribiners or other easily engaged and released transport devices to carry a strut, one responder on each end, the responders dropping the struts into, for example, a below-grade trench. Reflective tape applied to the exterior of the barrel may be useful as a marker in dark, underground environments.

Figure 3:
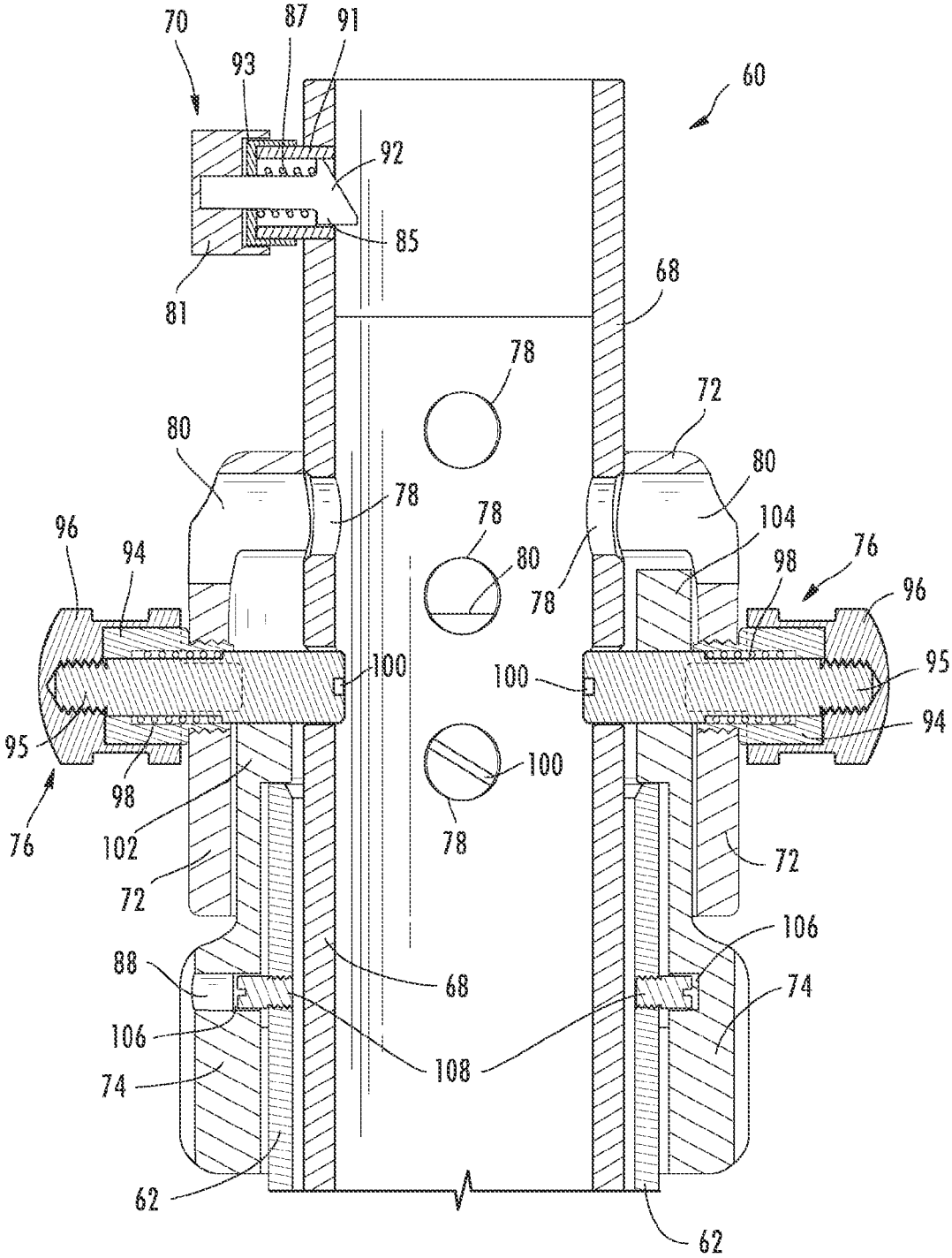
FIG. 3 is a longitudinal sectional view from the front center of a portion of the strut illustrated in FIG. 2 and illustrating the piston retained by piston-retaining pins.

Turning now to FIG. 3, FIG. 3 illustrates a longitudinal sectional view from the front center of a portion of the strut 60 illustrated in FIG. 2. FIG. 3 shows the piston 68 retained by spring-biased piston-retaining pins, shown generally at 76, which are fixedly secured to the first collar 72 and extend through corresponding orifices 78 in the piston. The piston 68 extends through annular openings defined by the first and second collars, 72, 74, respectively, and into the barrel 62. The piston has a series of longitudinally spaced orifices 78 at each of 0°, 90°, 180°, and 270° into which a retaining pin may be inserted, including those illustrated at 90° and 270° in FIG. 3 in which pins 76 are inserted.

The piston includes the quick disconnect shown generally at 70 adjacent the top of the piston for receiving various attachments, including the V-block illustrated in FIG. 1. The quick disconnect 70 is spring-activated and comprises a knob 81 into which is fixed a striker pin 85. A spring 87 mounted circumferentially about the striker pin 85 and enclosed in a housing 91 mounted in the piston wall biases against a spring plate 93 mounted to the housing and about the striker. Pulling on the knob 81 retracts the striker against the force of the spring and out of retaining contact with whatever corresponding attachment was inserted into the piston.

The end of the striker that inserts through the piston wall includes an inclined striker surface 92 so that when an attachment, such as that the V-block 28 illustrated in FIG. 1, is inserted into the piston, then the striker will retract to allow the V-block to be inserted into the piston. The spring 87 activates the striker to snap back into place and to secure the attachment against removal by pushing the striker into a corresponding surface on the attachment (not illustrated). The first responder pulls the striker handle to move the striker radially outwardly, thereby disengaging the striker from the attachment for removal or exchange of attachments.

The piston-retaining pins 76 have a housing 94 that is threaded for screw attachment to corresponding threads in orifices in the first collar 72. The housing is an annular member that contains a shaft 95 secured at one end to a retaining-pin knob 96 and circumferentially expanded at the other end to define an intermediate space between the retaining pin and pin housing in which is contained a spring 98. The terminus of the circumferentially expanded portion of the first-collar retaining pin 76 defines a slot 100 for screw assembly of the pin and handle. By pulling on the knob 96 against the bias of the spring, the pin retracts radially outwardly from the orifices in the piston so that the piston can be released from the first collar for axial movement within the barrel. The slot 100 on the piston-retaining pin that is located at 0° (at the rear of the strut in the view of FIG. 3) can be seen in the lowest piston orifice 78, looking through the section from the front of the section to the rear. The lower edge of the portion of a viewport passage 80 that is located at 0° (at the rear of the strut in the view of FIG. 3) can be seen in the middle piston orifice 78 at 0° looking through the section from the front of the section to the rear.

Turning now to the second collar 74 as illustrated in FIG. 3, the second collar 74 includes a reduced diameter portion that fits underneath the inner annular circumference of the first collar. The top surface of the second collar is not flush and forms a circumferentially inclined ratchet surface 103 (FIG. 9) extending from the top of the barrel 62 that can be tightened against the piston-retaining pins to secure the strut length. A lower edge 102 of the ratchet surface adjacent the top of the second collar 74 can be seen on the left-hand side of FIG. 3 and an upper edge 104, forming a stop, can be seen on the right-hand side. The ratchet collar is also illustrated in a perspective view in FIG. 9 and its operation is described in connection with this figure.

The lower portion of the second collar contains a track 106 into which are fitted threaded pins 108 that are screwed into corresponding threads in the barrel. The second collar 74 can be rotated about these pins and is rotatingly retained on the barrel by cooperation of the pins 108 and track 106. The track captures the barrel by the pins and holds it in place while allowing rotation of the second collar about the barrel. Also shown is orifice 88, which extends from the outer surface of the collar 74 and intersects at a right angle track 106. By rotating the collar 74, orifice 88 lines up with the individual threaded receptacles in the barrel for insertion and removal of threaded pins 108. It should be recognized that the circumferential track could be placed, if desired, on the external surface of the barrel with threaded pins inserted through multiple orifices 88 in the second collar and screwed into corresponding threads in the orifices so as to protrude into and engage the track on the barrel in a rotatingly secured fashion.

Figure 4:
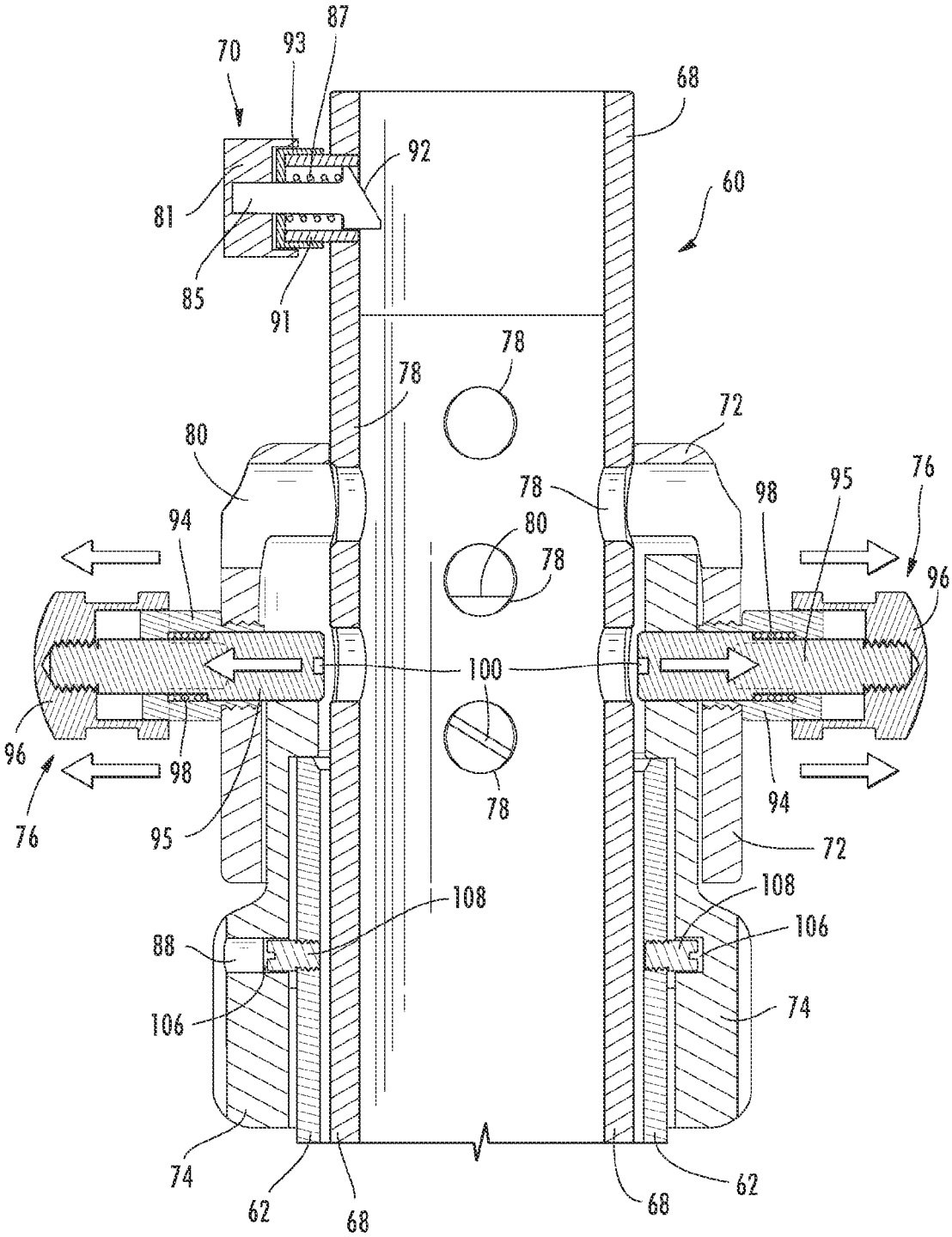
FIG. 4 is a longitudinal sectional view from the front center of a portion of the strut illustrated in FIG. 2 and illustrating the piston-retaining pins in a retracted position.

FIG. 4 is a longitudinal sectional view from the front center of a portion of the strut 60 illustrated in FIG. 2. FIG. 4 differs from FIG. 3 in that FIG. 4 illustrates the piston-retaining pins shown generally at 76 in a radially retracted position, retracted in the direction of the arrows. The knobs 96 have been pulled back in the direction of the arrows to compress the springs 98 and the piston-retaining pins 95 have been pulled against the bias of the springs out of the orifices 78 in the piston 68, which releases the piston for axial movement.

Figure 5:
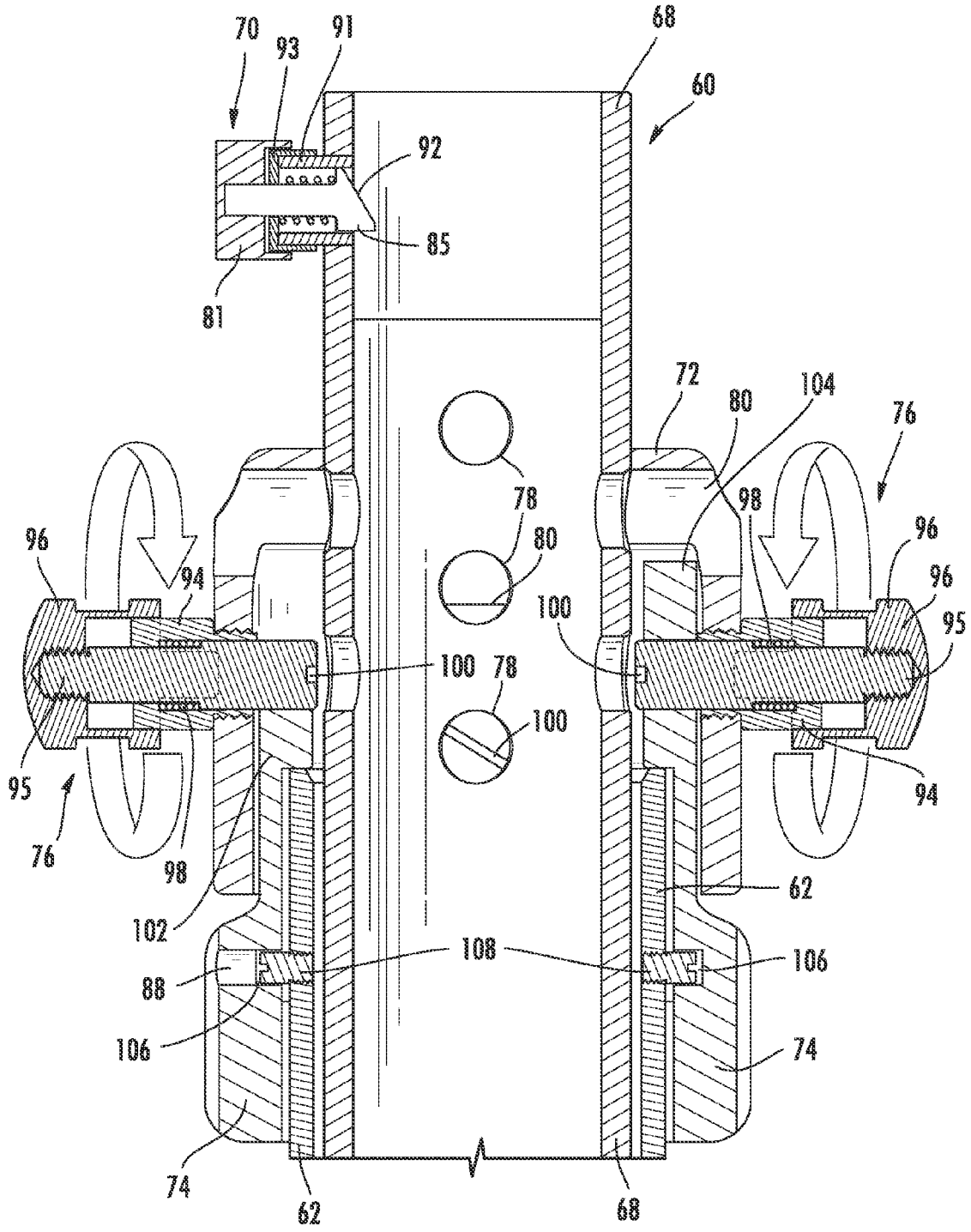
FIG. 5 is a longitudinal sectional view from the front center of a portion of the strut illustrated in FIG. 2 and illustrating rotation of the retracted piston-retaining pins to secure them against insertion into the piston wall.
Figure 6:
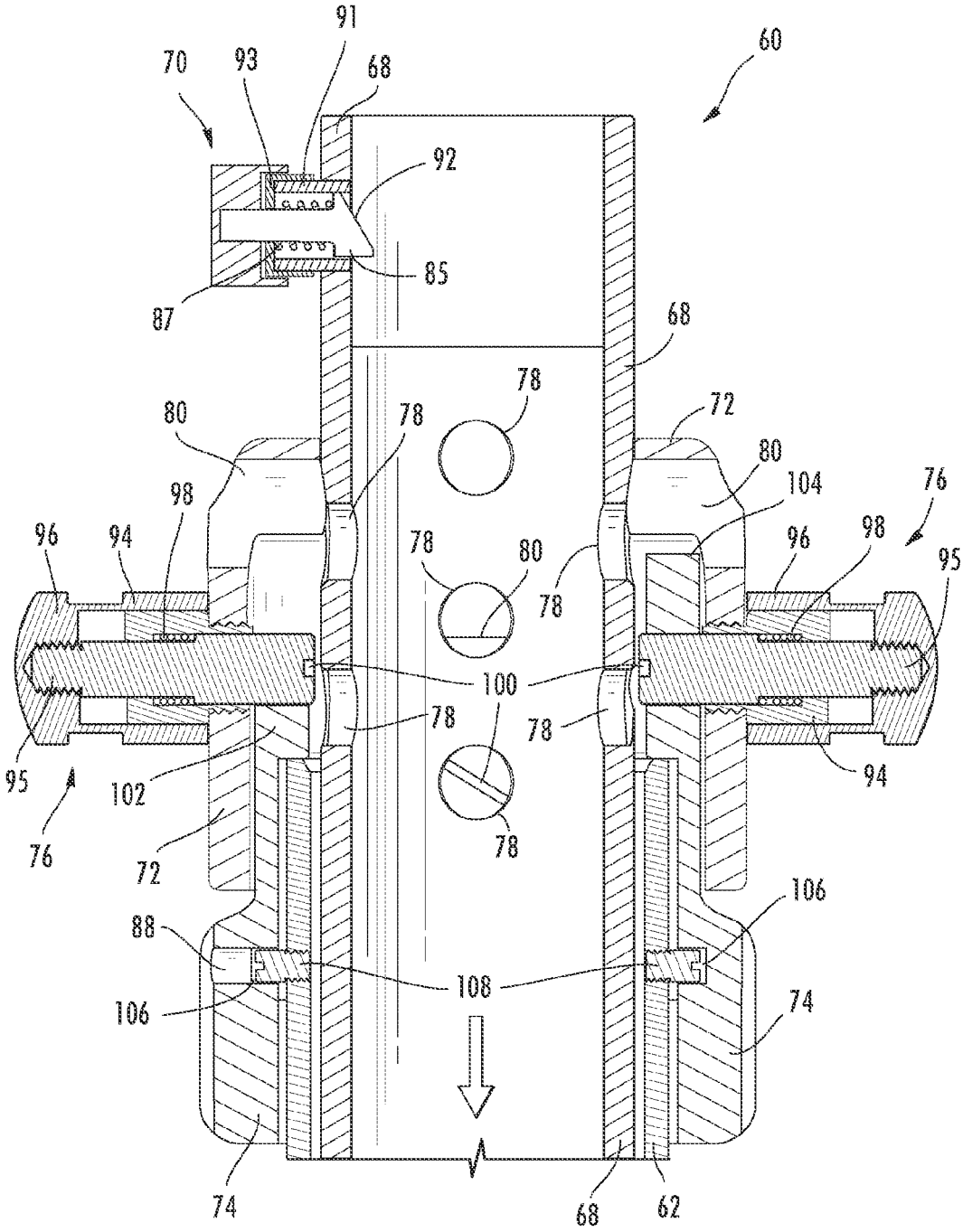
FIG. 6 is a longitudinal sectional view from the front center of a portion of the strut illustrated in FIG. 2 and illustrating the retracted piston-retaining pins secured against insertion into the piston wall for axial adjustment of the piston position.

FIG. 5 is a longitudinal section from the front center of a portion of the strut 60 illustrated in FIG. 2 and illustrating rotation of the retracted piston-retaining pins 76 to secure them against re-insertion into the orifices 78 in the piston wall. In FIG. 6, the pins 76 have been fully retracted from the piston and rotated and are precluded from engaging the piston. The piston can now be extended or retracted from the barrel without interference from the retaining pins.

Figure 7:
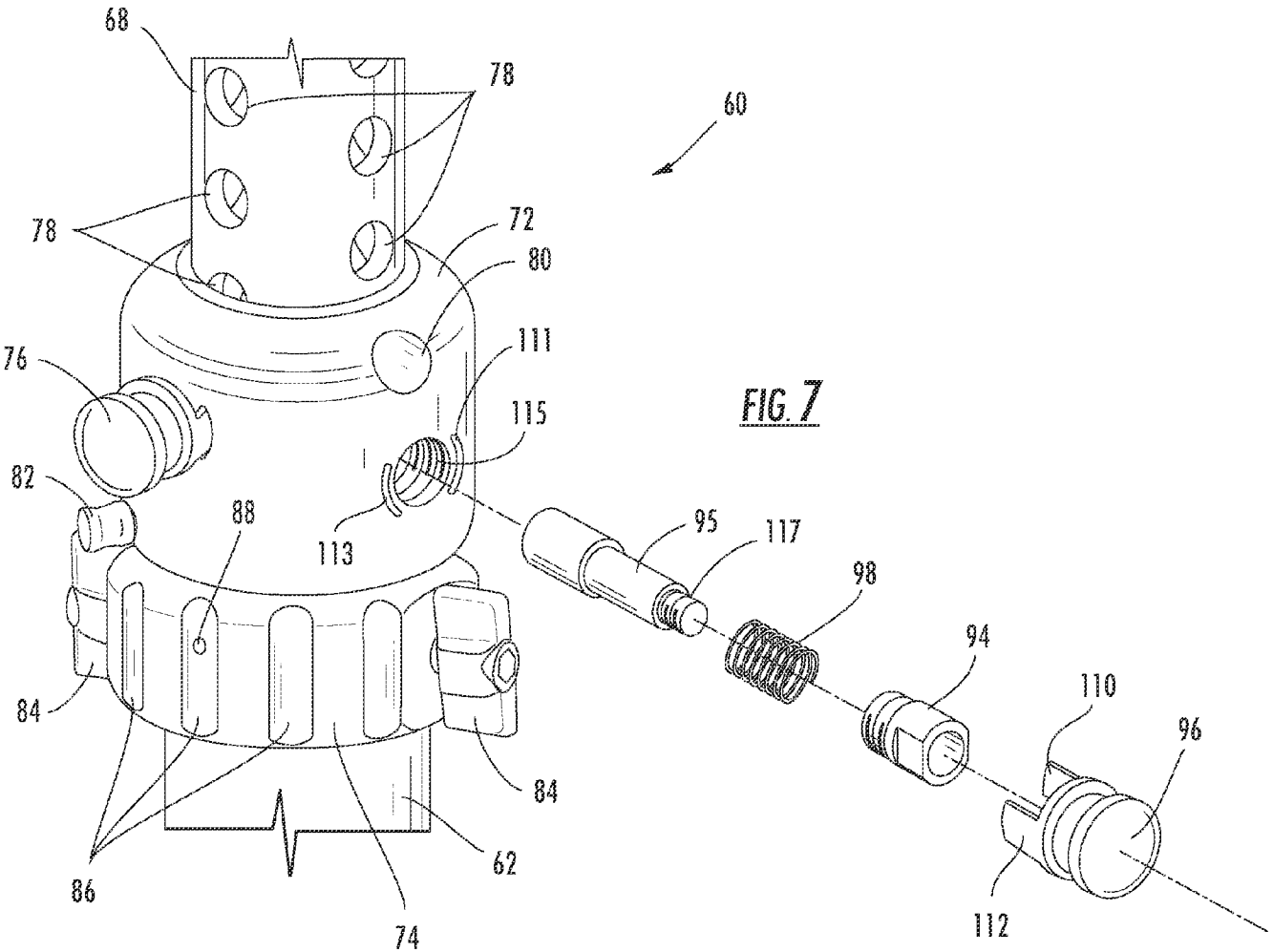
FIG. 7 is a front left-hand perspective view of a portion of the strut illustrated in FIG. 2, illustrating one of the piston-retaining pins in exploded perspective.

FIG. 7 is a front left hand perspective view of a portion of the strut illustrated in FIG. 2 and illustrates one of the piston retaining pins in exploded perspective. The knob 96 by which the piston retaining pin is pulled has wing portions 110, 112 on opposite sides thereof that fit into corresponding slots 111, 113 on the first collar for allowing the piston-retaining pin to be inserted into orifice 78 in the piston. The piston-retaining pin can be retained out of contact with the piston against the bias of the spring by pulling the knob 96 radially away from the piston 68 and the first collar 72 and then turning the knob 96 so that the wings 110, 112 engage the solid wall of the first collar and do not fit into the slots 111, 113. The retaining pin is assembled by screwing the housing 94 into the threaded orifice 115 provided in the first collar, and then inserting the pin with the spring mounted onto the spring shaft of the pin backward through the first collar and into the housing 94. The head 117 of the retaining pin is then screwed into the handle to complete the assembly and to secure the retaining pins within the first collar, completing the retaining pin and the collar assembly.

Figure 8:
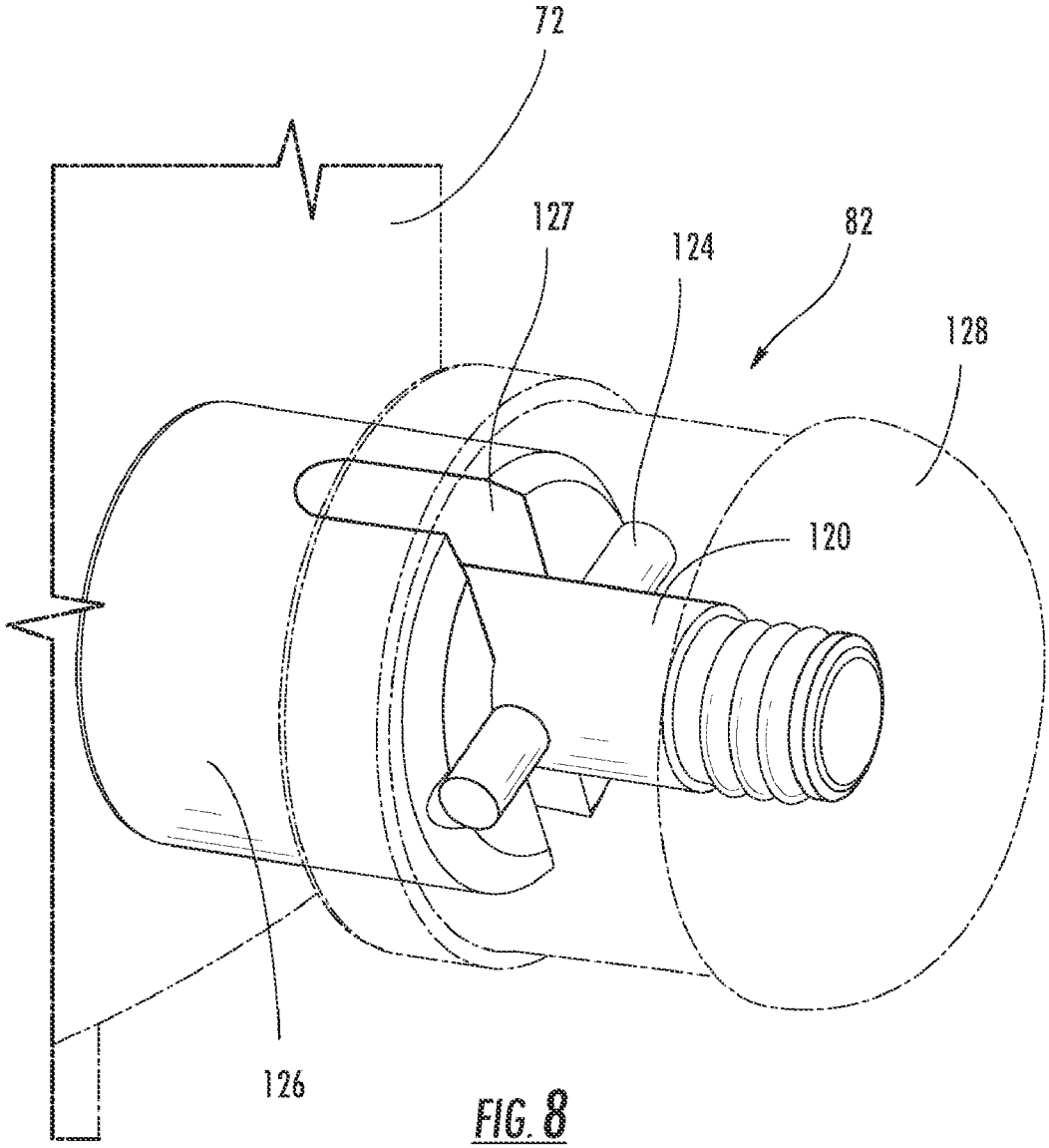
FIG. 8 is a left hand perspective view of a portion of the internal structure of the first collar retaining pin illustrated in FIGS. 2 and 7 and showing the pin cap in shadow.
Figure 9:
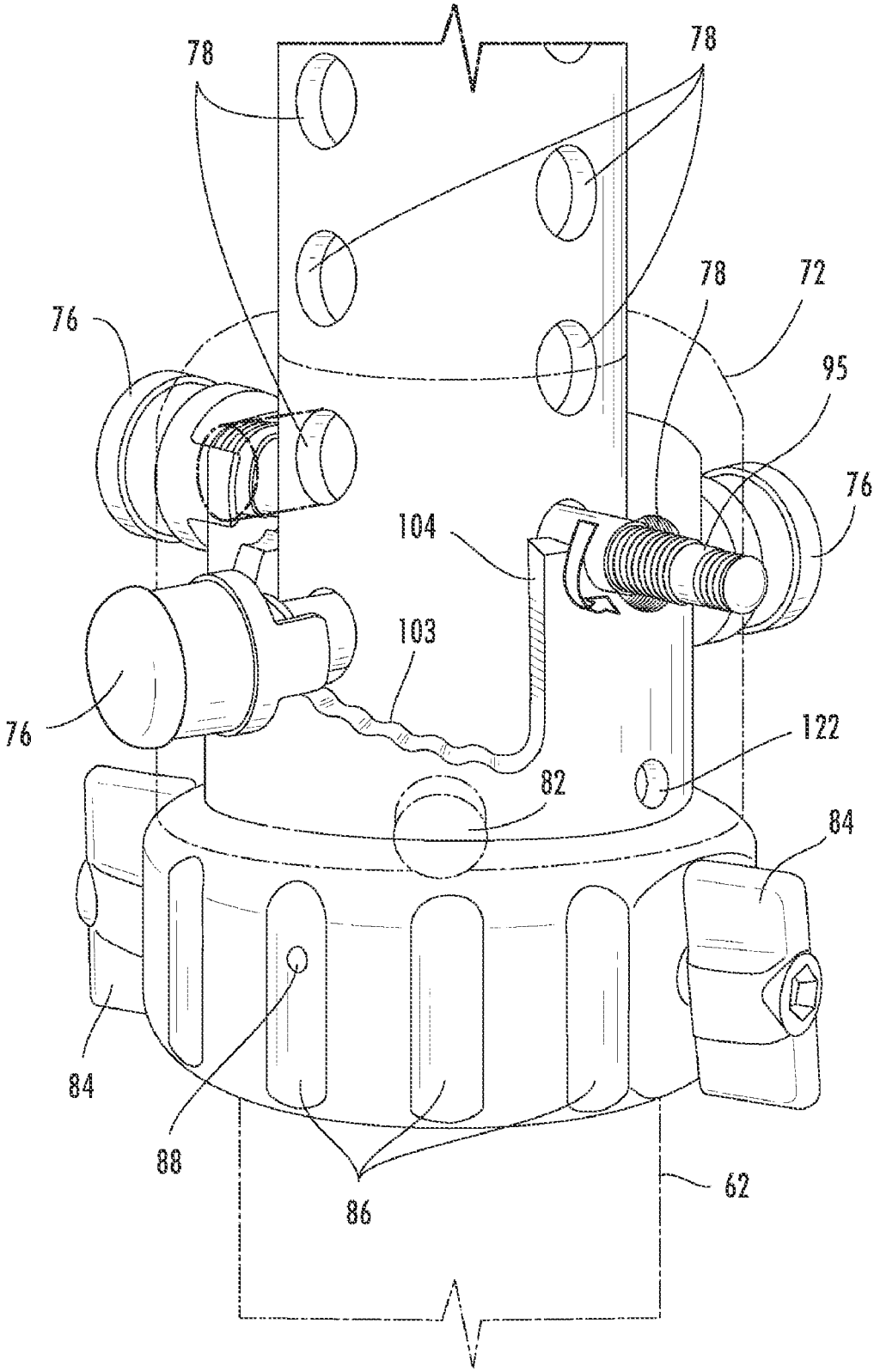
FIG. 9 is a front center perspective view of a portion of the strut illustrated in FIG. 2 and showing the first collar in shadow, a piston retaining pin with the cap removed, and portions of the structure of the second collar that lay beneath the first collar.

FIG. 8 illustrates generally at 82 the locking pin for the first collar, which precludes the first collar from rotating. This locking pin is useful for precluding rotation of the first collar during storage and transport of the strut and will typically be disengaged for rotation of the first collar during deployment. FIG. 8 shows the structure of this locking pin, which contains a central shaft 120 corresponding to an orifice 122 in the wall of the second collar (FIG. 9), a knob 128, in shadow, into which mounts the end of the shaft opposite the orifice 122, a slotted housing 126 having a slot 127 that mounts the shaft and handle to the wall of the first collar 72, and a dowel 124 passing through the shaft at right angles to shaft axis. When extracted from the corresponding orifice and rotated 90°, the right angle dowel 124 engages the housing 126 for the locking pin shaft 120 to hold the shaft 120 out of engagement with the orifice 122 on the first collar, thereby enabling rotation of the first collar. To lock the first collar, the knob 128 can be turned 90° to fit the dowel 124 in slot 127, allowing the spring to push to locking pin shaft into orifice 122.

FIG. 9 illustrates the structure of the second collar and shows the circumferentially inclined ratchet surface 103 on the upper section of the second collar. Ratchet surface 103 has sloping teeth and fits underneath the first collar to secure the piston-retaining pins 76 in place in piston orifices 78 in a tight arrangement. Once the retaining pins are in place in the desired orifices 78, the first responder rotates the second collar, the direction of the arrow showing the ratchet surface slipping under the pin in the direction of tightening rotation, until the ratchet surface is snug against pin 76. The first responder then tightens down the second collar retaining studs 84 against the barrel to preclude further rotation of the second collar, thereby precluding the second collar from rotating out of contact with the pins and loosening the fit.

To release the piston from the barrel, the first responder first loosens the second collar retaining studs 84 and then rotates the collar in the reverse direction from tightening the ratchet surface against the pins so that the piston-retaining pins can be withdrawn. Once withdrawn, the first responder can lower the piston in the barrel for to shorten the length of the strut or for removal from the accident site. The piston can also be extended further from the barrel up to the last available orifices 78 in the piston if it is necessary to lengthen the strut.

Figure 10:
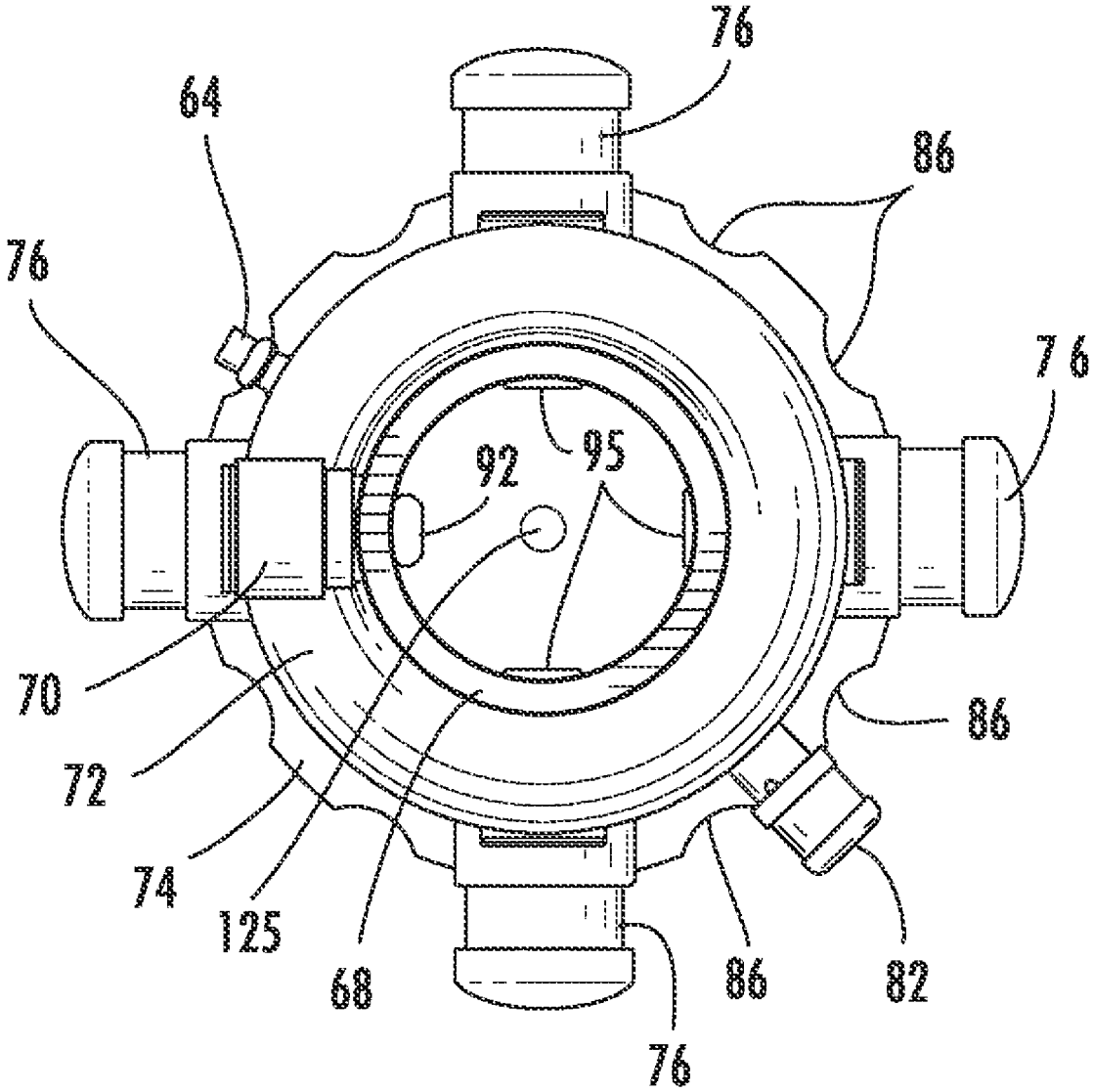
FIG. 10 is a top plan view of the strut of FIG. 2, looking down on the piston, barrel, and collar assemblies.

FIG. 10 illustrates a top plan view of the strut of FIG. 2 looking down on the piston and the collar assemblies. Proceeding from the center of the piston radially outwardly, the view of FIG. 10 shows that the bottom of the piston is a solid surface having an orifice 125 in the center. A readily replaceable elastomeric fitting (not shown) adapted to be retained in the orifice 125 provides a seal for pneumatically lifting the piston and precludes the piston from readily falling out of the barrel when the second collars retaining studs and the piston-retaining pins are disengaged. The elastomeric fitting can be, for example, a removable rubber cup tapered for an interfering fit with the interior diameter of the barrel. The interfering fit should be sufficient to preclude the piston readily falling out of the barrel prior to being secured and sufficient to provide axial movement with a pneumatic assist. The cup normally is held in place at the bottom of the piston by a washer and bolt.

The ends of three piston-retaining pins 95 extend radially inwardly from the internal surface of the piston 68 at each of 0°, 90°, and 180°, proceeding clockwise from the top of the drawing. The view of the end of the fourth piston-retaining pin at 270° is obscured by the chamfered surface 92 of the striker plate on quick disconnect 70 at the top of the piston above the pin 76. Each of the four piston-retaining pins 76 and the first collar retaining pin 82 extends radially outwardly from the first collar 72, retaining pin 82 shown in this view located at approximately 135°. The view of FIG. 10 shows the rounded top of the first collar 72 circumscribed by the external surface of the larger diameter portion of the second collar 74, the second collar 74 having thumb grooves 86 for providing a grip for rotating the second collar. The barrel is located radially outside the piston and within the first and second collars and so cannot be seen in this view. Air nipple 64 extending radially outwardly from the barrel can be seen at approximately 292°.

The well-equipped first responder typically keeps a variety of lengths of struts in their truck. The assembled pistons and barrels may be carried vertically in an upright mounting frame with the head and feet attachments in close proximity for rapid deployment. Longer struts may be horizontal stored. On arriving at and assessing an accident scene, for example, a trench collapse, the first responders generally will determine and pull out of the truck the desired lengths of strut and attachments. Runners typically carry the selected items to the scene and place head and foot attachments in the struts, attach the air supply, and may attach carabiners or other readily releasable carrying lines to each end of a strut. The runners can then carry the struts along a trench, one along each side of the trench to the desired locations. Sheets of plywood or other support sheets may have been placed in the trench for bracing against the struts and retaining the loose trench wall. Another rescuer normally will be situated on a ladder near the top of the trench for safety.

In the practice of the invention, the runner normally will then disengage the first collar locking pin, the retaining pins, and then loosen the second collar locking studs before lowering the strut into the trench to the rescuer located there. The rescuer in the trench guides placement of the strut. For example, in a typical trench, the strut may be placed horizontally between lengths of plywood situated on opposite walls of the trench. The rescuer "shoots" the strut by applying air to the piston to extend the piston tight against the opposing walls. The rescuer then inserts the first-collar retaining pins, rotates the second collar to tighten the ratchet surface against the retaining pins, and screws down the studs on the second collar to hold the second collar tight against the barrel, maintaining the piston in its length and the strut as a brace against the trench walls. The rescuer disconnects the air and deploys the next strut. If the trench is deep, the rescuer may be required to go farther into the trench, each time proceeding no farther than a safely shored area to deploy the next strut. A typical recovery may take several hours.

To remove the strut, the responder may first connect the air source to maintain the strut in position while the retaining pins are disengaged. Responders remove a strut by loosening the second collar retaining studs and rotating the second collar counterclockwise to release the first collar retaining pins. The responder turns the first collar retaining pins to disengage them from the piston and to allow the piston to be retracted and removed. The responder can turn the first collar retaining pins to reinsert them into the holes in the piston with the piston lowered and then reengage the first collar locking pin to hold the first collar in place. It is not necessary to tighten the second collar studs, although it is desirable to do so for storage of the strut to preclude rotation of the second collar.

The invention has been described with specific reference to preferred embodiments. However, variations can be made within the scope and spirit of the invention as described in the foregoing specification as defined in the appended claims.

What is claimed is:

1. A strut having a barrel containing an extendable and retractable piston, the piston having orifices for receiving piston-retaining pins for retaining the position of the piston relative to the barrel and defining the length of the strut, the strut further comprising first and second collar assemblies, the first collar assembly having a first collar circumscribing said piston and a plurality of retractable piston-retaining pins extending from said first collar, said pins extending inwardly from said first collar through corresponding said orifices in said piston to retain said piston and extending outwardly from said first collar for retraction from said orifices in said piston for releasing said piston for extension and refraction, and said second collar assembly having a second collar circumscribing said barrel and rotatably secured to said barrel, and a portion of said second collar extending underneath and overlaid by said first collar, whereby upon rotation, the portion of said second collar extending underneath said first collar contacts and supports said plurality of piston-retaining pins.

2. The strut of claim 1 wherein said second collar further comprises an interior circumferential track for receiving an outwardly protruding portion of said barrel, whereby said second collar is rotatably secured to said barrel.

3. The strut of claim 2 wherein said outwardly protruding portion of said barrel comprises at least two pins fixed to and extending from said barrel and fitted into said track on said second collar.

4. The strut of claim 3 wherein said second collar comprises an orifice extending from the exterior to said track, thereby providing access to said pins fixed to said barrel for inserting and removing said pins.

5. The strut of claim 1 wherein said second collar further comprises a portion extending exteriorly of said first collar, said exteriorly extending portion providing a surface for rotation of said collar about said barrel.

6. The strut of claim 5 wherein said exteriorly extending portion of said second collar comprises rotatable studs for engaging said barrel and securing said second collar against rotation about said barrel.

7. The strut of claim 1 wherein said portion of said second collar extending underneath said first collar is an annular portion further comprising an inclined circumferential surface for engaging and supporting said piston-retaining pins.

8. The strut of claim 7 wherein said inclined circumferential surface comprises sloping teeth for engaging said piston-retaining pins upon rotation to support said piston-retaining pins.

9. The strut of claim 7 wherein said inclined circumferential surface further comprises a stop at the uppermost end for precluding further rotation of said second collar.

10. The strut of claim 1 wherein said piston-retaining pins are fixed to said first collar and are biased for insertion into said orifices in said piston.

11. The strut of claim 10 wherein said piston-retaining pins are rotatable upon retraction to remain in a retracted position when released, thereby providing for movement of said piston axially of said barrel.

12. The strut of claim 1 wherein said first collar assembly further comprises a retractable pin mounted on said first collar, said retractable pin engaging an orifice in said portion of said second collar underlying said first collar to preclude rotation of said first collar about said second collar.

13. A strut comprising:

a) a barrel;

b) a pneumatically extendable piston extending from said barrel, said piston having a plurality of circumferentially and longitudinally spaced orifices circumscribing said piston;

c) a first collar assembly circumscribing said piston, said collar assembly comprising a first collar, a plurality of circumferentially spaced retractable spring-biased piston-retaining pins corresponding to said piston orifices and extending into said orifices; and d) a second collar assembly circumscribing said barrel and having an upper reduced diameter portion extending under said first collar and a lower expanded diameter portion beneath said first collar providing a grip for rotating said second collar, said reduced diameter portion terminating in an inclined circumferential surface for engaging and supporting said piston-retaining pins, said inclined surface having sloping teeth for engaging said piston-retaining pins upon rotation to support said piston-retaining pins and a stop at the uppermost end of said inclined surface for precluding further rotation of said second collar, said expanded diameter portion having an interior circumferential track for receiving outwardly protruding pins extending from said barrel, whereby said second collar is rotatably secured to said barrel, and rotatable studs mounted in said expanded diameter portion for securing said second collar assembly against rotation on said barrel.

14. A method for deploying a strut having a barrel and piston comprising the steps of releasing a first collar from a second collar, releasing the second collar for rotation on the barrel, retracting piston-retaining pins on the first collar from the piston, extending the piston, reinserting the piston-retaining pins into the piston, rotating the second collar snug against the piston-retaining pins, and securing the second collar against rotation.

15. The method of claim 14 wherein the step of extending the piston comprises pneumatically extending the piston.

16. The method of claim 14 further comprising the step of assembling the strut, wherein said assembly step comprises inserting a barrel into an orifice defined by the second collar, locating an orifice in the second collar over a pin receiving hole in the barrel, inserting a pin into the orifice and securing the pin into the barrel, rotating the second collar to locate at least one additional pin receiving hole in the barrel and repeating the pin inserting and securing steps, securing the piston-retaining pins in the first collar in a retracted condition and placing the first collar over the second collar, inserting the piston into the barrel through an orifice defined by the first and second collars, aligning holes in the piston with the piston-retaining pins in the first collar, and extending the piston-retaining pins into the holes in the piston.

17. The method of claim 16 further comprising the step of securing the first and second collars against rotation and securing the first collar against movement axially of the strut.

* * * * *